United States Patent [19]

Miyaki et al.

[11] Patent Number: 4,656,990

[45] Date of Patent: Apr. 14, 1987

[54] METHOD AND APPARATUS FOR CONTROLLING FUEL INJECTION TIMING

[75] Inventors: Masahiko Miyaki, Oobu; Hideya Fujisawa, Kariya, both of Japan

[73] Assignee: Nippondenso Co., Ltd., Kariya, Japan

[21] Appl. No.: 652,564

[22] Filed: Sep. 20, 1984

[30] Foreign Application Priority Data

Sep. 21, 1983 [JP] Japan ..... 58-175980

[51] Int. Cl.[4] ..... F02M 39/00

[52] U.S. Cl. ..... 123/494; 123/357; 123/500; 73/119 A

[58] Field of Search ..... 123/357-359, 123/494, 500, 501, 502, 467; 73/119 A

[56] References Cited

U.S. PATENT DOCUMENTS

| | | | |
|---|---|---|---|
| 4,258,324 | 3/1981 | Henrich | 73/119 A |
| 4,348,895 | 9/1982 | Straubel | 73/119 A |
| 4,359,032 | 11/1982 | Ohie | 123/467 |
| 4,435,128 | 3/1984 | Frey | 73/119 A |
| 4,475,519 | 10/1984 | Eheim | 123/357 |

FOREIGN PATENT DOCUMENTS

| | | | |
|---|---|---|---|
| 55-54642 | 4/1980 | Japan | 123/494 |
| 0163153 | 10/1982 | Japan | 73/119 A |

*Primary Examiner*—Carl Stuart Miller
*Attorney, Agent, or Firm*—Cushman, Darby & Cushman

[57] ABSTRACT

An apparatus for controlling fuel injection timing, for use in a fuel injection pump of a diesel engine, comprises a toothed wheel coaxially and fixedly mounted on a drive shaft of the fuel injection pump, first and second detectors for detecting the rotational position of the tooth wheel, and a control unit, having a microcomputer, for actuating a fuel injection timing changer of the pump according to the phase difference between signals from the first and second rotational position detectors for controlling fuel injection timing. The first rotational position detector is fixedly mounted on a pump housing and the second rotational position detector is fixedly mounted on a member rotatably provided around the drive shaft of the pump. The member is generally used for converting the rotational movement of the drive shaft to the reciprocation of a plunger of the pump which supplies fuel into cylinders of the engine. The phase difference corresponds to the actual injection timing condition. Therefore, the control unit actuates the injection timing changer so that the phase difference is approached to a desired phase difference predetermined according to the engine condition.

2 Claims, 4 Drawing Figures

METHOD AND APPARATUS FOR CONTROLLING FUEL INJECTION TIMING

BACKGROUND OF THE INVENTION

This invention relates to a fuel injection pump, and more particularly to an apparatus and method for controlling fuel injection timing of a fuel injection pump of the distribution type for use in diesel engines, using a control unit having a microcomputer.

It is well known that various types of fuel injection pumps are employed for supplying fuel into cylinders of a diesel engine. Particularly, fuel injection pumps of the distribution type are widely used because of their simple structure and small size. The fuel injection pumps are arranged so as to convert the rotation of a drive shaft of the pump to the reciprocation of a plunger by a roller ring, a face cam and so on so that fuel is supplied under pressure into cylinders of a diesel engine by the plunger.

On the other hand, it is generally required that fuel injection pumps supply fuel into cylinders of a diesel engine in the most beneficial timing according to the number of rotations of the engine for increasing the engine performance. Therefore, fuel injection pumps are provided with various types of control systems for controlling fuel injection timing.

In conventional fuel injection pumps of the distribution type, a feedback control system is generally used as a control system for controlling fuel injection timing, and, for example, is arranged such that the position of a timer piston, which is detected as an actual timing of fuel injection, is adjusted to a desired or reference position. In the feedback control system, a differential transformer or the like, which is expensive, is used for accurately detecting the position of the timer piston. Furthermore, as is described in Japanese Laid-open Patent Application No. 55-54642, there is provided a control system of fuel injection timing having a detector which detects the rotational position of a roller ring by tracing the roller ring. However, in the case that the control system is employed for controlling fuel injection timing, it will be required that the roller ring is formed in a particular shape.

On the plus side, the above-mentioned conventional devices are being appraised successfully at a site to accurately output information relating to an actual timing of fuel injection. However, on the other hand, the devices are generally expensive.

Unlike a carburetor and the like in a gasoline engine, a fuel injection pump in a diesel engine weighs on the total cost of a diesel engine. Therefore, it is desired that fuel injection pumps are produced at a low cost.

SUMMARY OF THE INVENTION

It is, therefore, an object of the present invention to provide a new and inexpensive apparatus and method for accurately controlling fuel injection timing into cylinders of a diesel engine.

With these and other objects which will become apparent as the description proceeds, an apparatus for controlling fuel injection timing according to the present invention, which is provided to a fuel injection pump, comprises a toothed wheel coaxially mounted at a drive shaft of the pump, a first rotational position detector mounted on a pump housing, a second rotational position detector mounted on a roller ring which is used for converting the rotation of the drive shaft to the reciprocation of a plunger for supplying fuel under pressure into the cylinders, a control unit for controlling fuel injection timing according to outputs from the first and second rotational detectors, and a fuel injection timing adjusting device controlled by the control unit.

The control unit, having a well known microcomputer, is arranged to compute a phase difference between output signals from the first and second rotational position detectors, and to control a fuel injection timing adjusting device, which, for example, comprises a solenoid-controlled valve, a timer piston and the like, in accordance with the phase difference in order to supply fuel with a desired injection timing into engine cylinders.

The phase difference corresponds to the change of angle of rotation of the roller ring, i.e. the change of fuel injection timing. Therefore, an accurate fuel injection timing control will be performed with the phase difference being corrected to approach a value determined according to the engine condition.

This construction and arrangement according to the present invention, being capable of controlling fuel injection timing with accuracy, permits the use of a well known magnetic pickup or the like for the rotational position detector, which is inexpensive. In addition to this advantage, it is not required to use an analog-to-digital converter (A/D converter) or the like for inputting the detecting signal produced by the rotational position detectors to the control unit because the detecting signal is a digital-like timing signal, resulting in an useful and inexpensive apparatus for controlling fuel injection timing.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

As will be described hereinlater, an apparatus for controlling fuel injection timing according to the present invention comprises a microcomputer which operates in accordance with predetermined programs. Prior to describing detailed operations of the microcomputer, the construction and arrangement of the apparatus according to the present invention will first be described for a general understanding, referring to FIGS. 1 and 2 which show schematic cross-sectional views of the apparatus. The figures show the apparatus according to the present invention applied to a fuel injection pump of Bosch VE type. However, the apparatus is applicable to, for example, a distribution pump having an inner cam mechanism in which an inner cam ring, which causes a plunger to reciprocate for injecting fuel into combustion chambers, is arranged so as to be rotationally movable in a housing of the pump for controlling fuel injection timimg. In this case, a second signal detector, which will be described hereinlater, should be mounted on the inner cam ring.

Figure 1:
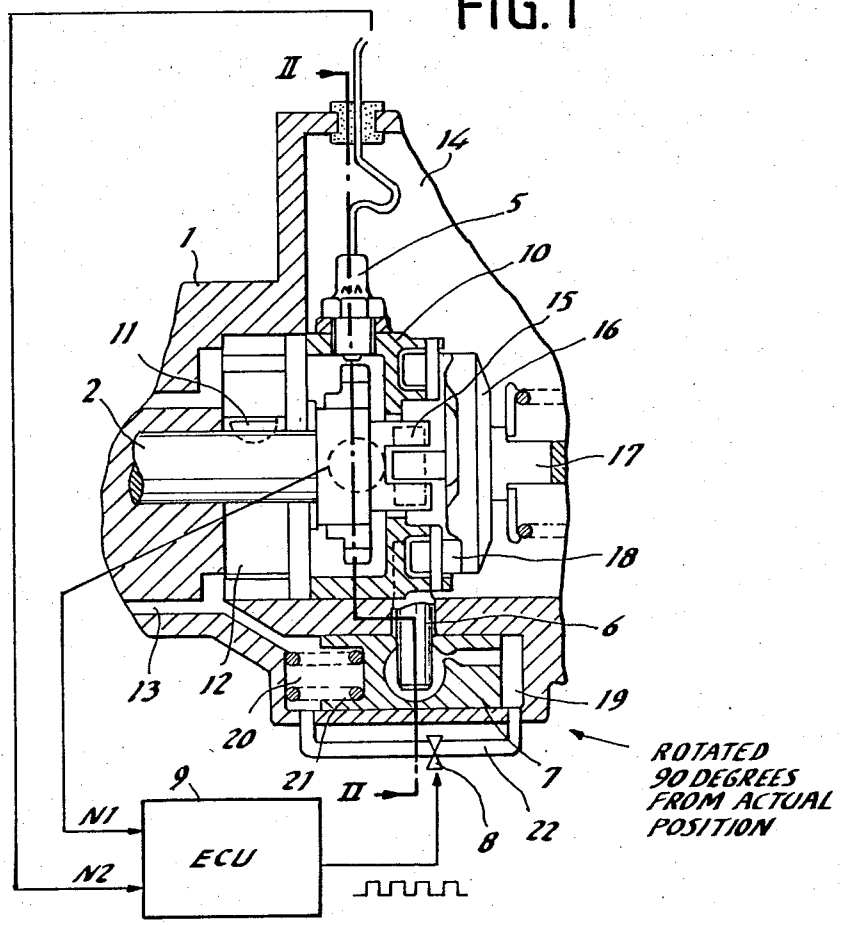
FIG. 1 is a schematic cross-sectional view of an apparatus for controlling fuel injection timing according to the present invention, applied to a well known fuel injection pump of the Bosch VE type.

In FIG. 1, illustrated at the reference 2 is a drive shaft (rotary shaft) which is supported within a pump housing 1. The drive shaft 2 is coupled to an output shaft of a diesel engine (not shown) by means of a well known timing belt, and is rotationally driven at a half speed of the engine. A well known vane type feed pump 12 is coaxially mounted on the drive shaft 2 by means of a mounting member 11 so as to be rotationally driven in company with the drive shaft 2. The vane type feed pump 12 functions to feed fuel under pressure controlled by a regulating valve (not shown) into the chamber 14 of the pump housing 1, the fuel being supplied through a passage 13 to the vane type feed pump 12. To the drive shaft 2, a face cam 16 is coupled by means of an Oldham coupling 15 so as to be rotatable together with the drive shaft 2 in the rotating direction and to be separately movable in the horizontal direction (axially). To the face cam 16 is fixedly coupled a plunger 17 which functions to feed fuel under pressure into engine cylinders. The plunger 17 is rotated according to the rotation of the drive shaft 2 and is reciprocated in the left and right directions in the figure with the face cam 16 being in contact with a roller 18, which is mounted on a roller ring 10. The reciprocation causes fuel to be led, compressed, and fed to a fuel injection nozzle (not shown) associated with engine cylinders after destribution.

In the fuel injection pump of the Bosch VE type, the fuel injection amount control is performed by using a well known spill ring mechanism and, thereby, the fuel compressed by the plunger 17 will be led into the chamber 14 at a time so that a desired amount of fuel is fed into each cylinder of an engine.

On the other hand, the fuel injection timing control is performed by rotating clockwise and counterclockwise the roller ring 10 provided with the roller 18 which causes the plunger 17 to effect the reciprocation. Namely, the angular position of the roller 18 with respect to the face cam 16 is changed by the rotational movement of the roller ring 10 and therefore the timing at which the roller 18 runs on a thick portion of the face cam 16 is controlled by rotationally moving the roller ring 10 in either direction. To adjust the angular position of the roller 18 with respect to the face cam 16, the roller ring 10 is coupled to a timer piston 7 by means of a pin 6, and the timer piston 7 is arranged to reciprocate within a bore formed in the pump housing 1. In FIG. 1, the timer piston section is shown to be rotated 90 degrees from it's actual position.

On both ends of the timer piston 7, two pressure chambers 19 and 20 are formed, so that the timer piston 7 is capable of reciprocating in the left and right directions in the figure in response to the change in the pressure in the pressure chamber 19. The right pressure chamber 19 communicates with the the chamber 14 formed in the pump housing 1 and therefore the pressure increased by the vane type feed pump 12 is applied to the right pressure chamber 19. The left presure chamber 20 communicates with the passage 13 and therefore the pressure approximate to atmospheric pressure is applied to the left pressure chamber 20. A coil spring 21 is provided in the left pressure chamber 20 so that the timer piston 7 is biased to the right direction in the figure. Therefore, the timer piston 7 is stationary when a rightward force of the coil spring 21 and the pressure in the right pressure chamber 19 are in a state of equilibrium.

The right pressure chamber 19 and the left pressure chamber 20 communicate with each other by a pathway 22 having an ON-OFF type solenoid-controlled valve 8. The solenoid-controlled valve 8, which is controlled by a control unit 9, is provided for controlling the pressure of fuel in the right pressure chamber 19 by changing the open/close duration ratio, thereby determining the position of the timer piston 7.

Generally, ON-OFF control of solenoid-controlled valve 8 is performed by the method in which a duty cycle of a pulse train signal is adjusted. It is assumed that, when the ratio of working time (ON time) to a whole duration i.e. sum of ON duration and OFF duration is equal to the ratio of OFF time to the same, the control is in a basic state. In the case of increasing the ratio of ON time, fuel in the right pressure chamber 19 is additionally led into the left pressure chamber 20 through the pathway 22 according to the increase of the ratio of ON time and therefore the pressure in the right pressure chamber 19 is decreased, resulting in the movement of the timer piston 7 in the right direction in the figure caused by the coil spring 21. On the other hand, in the case of increasing the ratio of OFF time, fuel in the right pressure chamber 19, which corresponds to the increase, is limited to flow into the left pressure chamber 20 and therefore the pressure of the right pressure chamber 19 is increased, resulting in the movement of the timer piston 7 in the left direction in the figure against the force of the coil spring 21.

Figure 2:
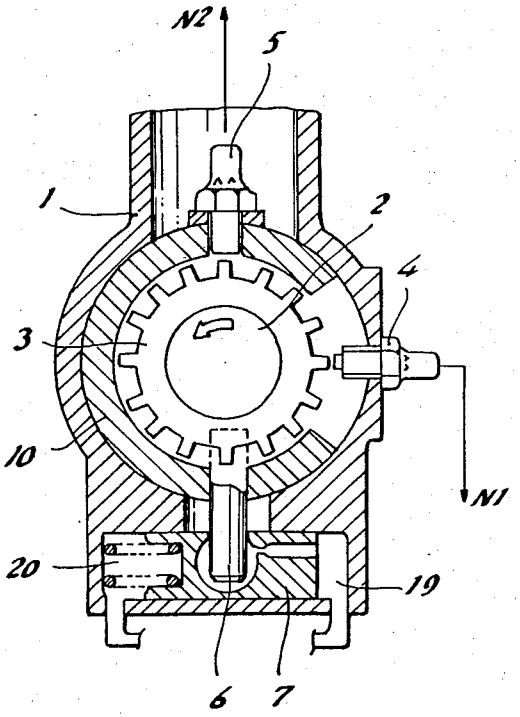
FIG. 2 is a schematic cross-sectional view taken along the line II—II of FIG. 1.

The movement of the timer piston 7 in the right and left directions causes the roller ring 10 to rotate clockwise and counterclockwise because the roller ring 10 is coupled to the timer piston 7 by means of the pin 6. In FIG. 2 which is a schematic cross-sectional view taken along the line II—II of FIG. 1, when the timer piston 7 is moved in the right direction in the figure due to the increase in the ratio of ON time, the roller ring 10 is rotated counterclockwise as indicated by an arrow and thereby the timing at which the roller 18 runs on a thick portion of the face cam 16 is delayed, which results in delaying the start fuel injection timing. On the other hand, in the case that the timer piston 7 is moved in the left direction due to the increase in the ratio of OFF time, the roller ring 10 is rotated clockwise and thereby the start fuel injection timing is advanced.

The above-mentioned system for changing fuel injection timing is well known. In a fuel injection pump having an apparatus for controlling fuel injection timing according to the present invention, two rotational position detectors 4 and 5 are used for accurately controlling injection timing. The rotational position detectors 4 and 5, which are electromagnetic pickup or the like, generate signals relating to a rotational position of a toothed wheel 3 fixedly mounted on the drive shaft 2. In the present invention, a magnetoresistance element (MRE), a Hall generator, an optical encoder or the like is capable of being employed as the rotational position detector, instead of an electromagnetic pickup. The drive shaft 2 is rotated in company with the toothed wheel 3 and the toothed wheel 3 is arranged to rotate inside the roller ring 10. The toothed wheel 3 has a plurality of equiangularly arranged teeth along the circumference thereof, and is used as a signal generator which generates a signal relating to a rotational position thereof. The first rotational position detector 4 is fixedly mounted on the pump housing 1 and the second rotational position detector 5 is fixedly mounted on the roller ring 10. Therefore, the second rotational position detector 5 is rotationally moved together with the roller ring 10. Each output of the detectors 4 and 5 is fed to the control unit 9 for controlling fuel injection timing. The control unit 9 comprises a well known microcomputer having a central processing unit (CPU), memories, input/output device (I/0), timer counter and the like.

Figure 3:
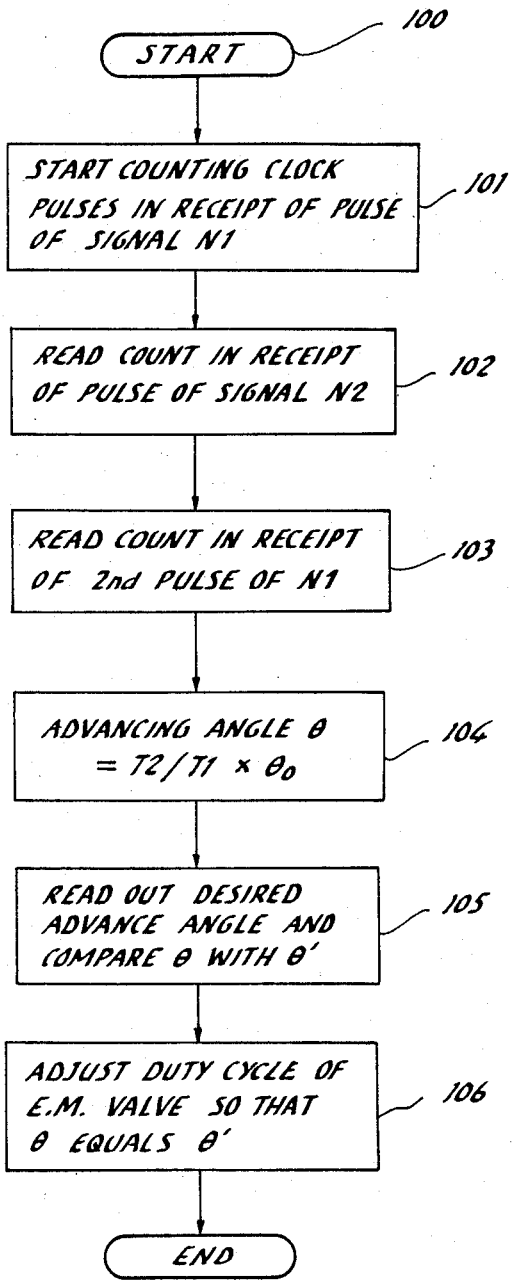
FIG. 3 is a schematic flowchart of the program provided for a microcomputer of the control unit of FIG. 1.

FIG. 3 is a schematic flowchart of the program provided for the microcomputer of the control unit 9. The program is stored in a nonvolatile memory, such as a read-only memory, included in the memories of the microcomputer.

In a step 100, the operation is started. The start of the operation is performed as an interrupt service at a predetermined interval, every predetermined angle of the engine crank shaft or a like timing.

Figure 4:
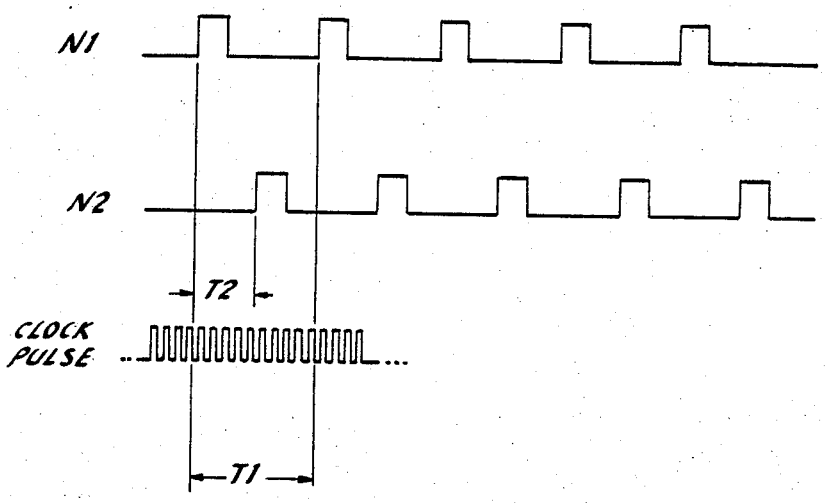
FIG. 4 is a timing chart showing signals from first and second signal detectors and a train of pulses produced in the control unit to measure time periods.

Nextly, in a step 101, when a signal N1 from the first rotational position detector 4 is inputted to the control unit 9, the number of clock pulses generated by a pulse generator of the control unit 9 is counted by a time-interval counter of the control unit 9 for measuring the following time interval. The counting of clock pulses is first performed until a signal N2 from the second rotational position detector 5 is inputted into the control unit 9. When the signal N2 is inputted, in a following step 102, the counted number of clock pulses is stored in a memory as time interval T2 between the signals N1 and N2. Continuously, the counting of clock pulses is performed until next signal N1 from the first rotational position detector 4 is inputted. When the next signal N1 is inputted, in a following step 103, the counted number of pulse is stored in the memory as time interval T1 between the first signal N1 and the next signal N1. The relationship between the signals N1, N2 and the times T1, T2 is shown in FIG. 4 as a timing chart.

In a step 104, the time interval T2 is divided by the time interval T1 and a resulted value (T2/T1) is multiplied by a teeth-interval angle $\theta_o$ which indicates an angle between two consecutive teeth of the toothed wheel 3, and thereby an advancing angle $\theta$ is computed. The advancing angle $\theta$ corresponds to the phase difference between the signals N1 and N2. Therefore, the advancing angle $\theta$ is used as a parameter for controlling fuel injection timing in the case that the phase difference between the signals N1 and N2 in an initial setting state is known. Furthermore, in the case that the two rotational position detectors 4 and 5 are arranged such that the signals N1 and N2 are outputted from the signal detectors 4 and 5 at the same time in the most retarded angle position in the range of use, the advancing angle value $\theta$ indicates an advancing angle of the roller ring 10 from the most retarded angle position.

In a step 105, the advancing angle value $\theta$ computted in the step 104 is compared with a desired advancing angle value $\theta'$ predetermined according to the number of rotations of the engine, engine load, and so on, and stored in a memory of the microcomputer of the control unit 9. In a step 106, a duty cycle of the solenoid-controlled valve 8 is adjusted such that the computted advancing angle value $\theta$ is equal to the predetermined advancing angle value $\theta'$. Therefore, fuel injection timing will be controlled.

The foregoing description describes only the preferred embodiment of the present invention. Various modifications are apparent to those skilled in the art without departing from the scope of the present invention which is only limited by the appended claims. Therefore, the embodiment shown and described is only illustrative, not restrictive.

What is claimed is:

1. A method for controlling fuel injection timing in a fuel injection pump for use in an internal combustion engine by operating means for changing fuel injection timing according to signals from first and second rotational position detectors which respectively detect the rotational position of a toothed wheel coaxially mounted on a drive shaft of said pump, said first detector being mounted on a pump housing and said second detector being mounted on a member rotatably provided around said drive shaft, said rotatable member being rotated by means of said injection timing changing means for changing fuel injection timing, said method comprising the step of:

(a) receiving signals relating to the rotational position of said toothed wheel by means of said first and second rotational position detectors;

(b) computing a time interval T2 between said signal from said first rotational position detector and said signal from said second rotational position detector;

(c) receiving a signal relating to the rotational position of said toothed wheel by means of said first rotational position detector;

(d) computing a time interval T1 between two continuous and signals from said first rotational position detector;

(e) computing the ratio of time interval T2 to time interval T1;

(f) computing an advancing angle value indicative of an actual fuel injection timing by multiplying the ratio (T2/T1) by an angle between two consecutive teeth of said toothed wheel; and (g) controlling said injection timing changing means so that the advancing angle approaches a reference advancing angle.

2. An apparatus for controlling fuel injection timing in a fuel injection pump of use in an internal combustion engine by operating means for changing fuel injection timing according to signals from first and second rotational position detectors which respectively detect the rotational position of a toothed wheel coaxially mounted on a drive shaft of said pump, said first dectector being mounted on a pump housing and said second detector being mounted on a member rotatably provided around said drive shaft, said rotatable member being rotated by means of said injection timing changing means for changing fuel injection timing, said apparatus comprising:

a control unit for receiving signals relating to the rotational position of said toothed wheel by means of said first and second rotational position detectors;

computing a time interval T2 between said signal from said first rotational position detector and said signal from said second rotational position detector;

receiving a signal relating to the rotational position of said toothed wheel by means of said first rotational position detector;

computing a time interval T1 between the continuous two signals from said first rotational position detector;

computing an advancing angle value in terms of an actual injection timing by multiplying the ratio (T2/T1) by an angle between two consecutive teeth of said toothed wheel; and controlling said injection timing changing means so that the advancing angle approaches a reference advancing angle.

* * * * *